US009334697B2

(12) United States Patent
Reinås et al.

(10) Patent No.: US 9,334,697 B2
(45) Date of Patent: May 10, 2016

(54) RISER RECOIL DAMPING

(75) Inventors: Lorents Reinås, Stavanger (NO); Tore Geir Wernø, Sandnes (NO); Morten Sæther, Lillestrøm (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 14/359,039

(22) PCT Filed: Nov. 18, 2011

(86) PCT No.: PCT/EP2011/070490

§ 371 (c)(1),
(2), (4) Date: Jun. 24, 2014

(87) PCT Pub. No.: WO2013/071982

PCT Pub. Date: May 23, 2013

(65) Prior Publication Data

US 2014/0318804 A1 Oct. 30, 2014

(51) Int. Cl.
*E21B 17/07* (2006.01)
*E21B 17/01* (2006.01)

(52) U.S. Cl.
CPC ..... *E21B 17/07* (2013.01); *E21B 17/01* (2013.01)

(58) Field of Classification Search
CPC ..... E21B 17/07; E21B 17/01
USPC ..... 166/367, 363, 364
See application file for complete search history.

(56) References Cited

U.S. PATENT DOCUMENTS

| | | | | | |
|---|---|---|---|---|---|
| 3,416,819 | A | * | 12/1968 | Day | 285/302 |
| 3,511,345 | A | * | 5/1970 | Ando et al. | 188/371 |
| 3,599,757 | A | * | 8/1971 | Takamatsu et al. | 188/371 |
| 3,856,335 | A | * | 12/1974 | Blake | 285/288.1 |
| 4,059,288 | A | | 11/1977 | Mohr | |
| 5,382,056 | A | | 1/1995 | Milberger | |
| 2011/0127041 | A1 | | 6/2011 | Edwards et al. | |

FOREIGN PATENT DOCUMENTS

WO WO 2009/153567 A1 12/2009

* cited by examiner

*Primary Examiner* — James G Sayre
(74) *Attorney, Agent, or Firm* — Birch, Stewart, Kolasch & Birch, LLP

(57) ABSTRACT

An apparatus for use with a subsea well includes an upper riser part, a lower riser part, and a weak link coupling the upper and lower riser parts together; and a mechanism coupled between the upper and lower riser parts for damping recoil of the upper riser part following a breaking of the weak link, damping resulting from a plastic deformation of a component or components of the mechanism occurring as the upper and lower riser parts separate.

11 Claims, 6 Drawing Sheets

RISER RECOIL DAMPING

TECHNICAL FIELD

The disclosure generally relates to riser recoil damping and more particularly to the damping of riser recoil following the breaking of a riser weak link designed to provide a failsafe mechanism.

BACKGROUND

A riser is a pipe extending from a drilling platform on the sea surface to the seabed and serves to effectively extend a subsea well to a surface drilling facility. The riser may be connected at the seabed to a blowout preventer and a wellhead. At the sea surface, the riser may be connected to a drilling ship (or platform). The riser may be used for transporting drilling mud from the borehole to the drill ship and also provides a channel for a drill pipe and other tools extending from the ship to the well head. As the ship is located on the sea surface, the ship will move up and down with the swell on the sea surface. Means are provided to allow vertical movement of the ship within a range of values, while maintaining a tension on the riser. However, these means are not sufficient to compensate for extreme movements of the ship, for example during very severe weather conditions. These compensating means may cease to operate unintentionally resulting in a non compensated ship or floating platform. Therefore, a weak link may be provided in the riser or riser couplings at a predetermined location or elevation which fails or releases under a predefined amount of tensile force, bending moment or combinations thereof on the riser. If a weak link fails or releases, the riser part below the weak link may stay connected to the blowout preventer, while the riser part above the weak link may stay connected to the ship. The sudden release of the upper riser part and its upward momentum may present a serious danger to the drilling ship. The upward movement may be driven further by a positive pressure of gas or fluids inside the riser.

SUMMARY

According to a first aspect of the present invention there is provided an apparatus for use with a subsea well and comprising: an upper riser part, a lower riser part, and a weak link coupling the upper and lower riser parts together; and a mechanism coupled between the upper and lower riser parts for damping recoil of the upper riser part following a breaking of the weak link, damping resulting from a plastic deformation of a component or components of the mechanism occurring as the upper and lower riser parts separate.

The mechanism may comprise a first part coupled to or integral with said lower riser part, and a second part coupled or integral with said upper riser part, the first and second parts cooperating to plastically deform one or both of the parts following a breaking of the weak link.

The plastic deformation may be a cutting through the second part by the first part.

The first part may comprise one or more shear knives and said second part comprising a shear plate or plates, wherein said plastic deformation is achieved by the shear knife or knives cutting through the shear plate(s).

The second part may comprise a cylindrical shear plate arranged coaxially about one or both of the riser parts, and said shear knife or knives extend radially outward from the upper or lower riser part.

The or each shear plate may be formed with a weakened area or areas extending axially along the plate such that each weakened area is engaged, following a breaking of the weak link, by a shear knife.

The or each weakened area may have a constant radial thickness along its axial extent; or a varying radial thickness along its axial extent such that the damping force exerted by the mechanism is controlled as the upper and lower riser parts separate.

Said plastic deformation may also be a bending in or of said second part by said first part.

Said first and second parts may comprise respective cylinders, telescopically engaged with one another.

A fluid tight seal may be formed between said first and second parts so as to contain fluid within the riser.

One of the cylinders may have formed thereon a restriction that is engaged by the other of the cylinders, or by a component supported by the other of the cylinders, during riser recoil to cause said plastic deformation. Said component may be an annular sleeve supported on a shoulder formed in the supporting cylinder.

According to a second aspect of the invention there is provided a riser or riser section for use with a subsea well and comprising a valve positioned within the riser or riser section, above a riser weak link, the valve being configured such that it is open in normal use and closes immediately following a breaking of the weak link so as to substantially contain fluid within the riser above the valve. Said valve may be a flapper valve.

The riser or riser section may further comprise a hold-open component coupled to or integral with a lower riser part beneath said weak link, the hold-open component holding open said valve when the weak link is intact, and, following a breaking of the weak link, being displaced from said valve to allow the valve to close.

DESCRIPTION

Figure 1:
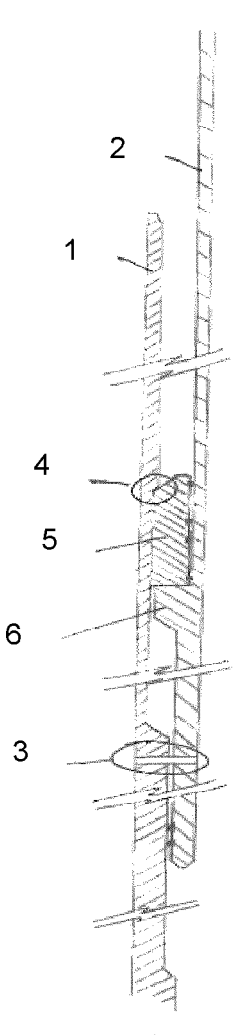
FIG. 1 shows a vertical cross section through a left hand side of a riser weak link section in a first, normal operating configuration.

FIG. 1 shows a mechanism for recoil damping which may be incorporated into a riser close to a weak link mechanism. By way of example, the lower riser part 1 may be coupled to a subsea assembly at the top of the well, e.g. incorporating a blow out preventer, whilst the second riser part 2 comprises the bottom end of the main riser section. The load carrying capacity of the damping mechanism ensures that it will not fail under loading before failure or release of a weak link. Although not considered in detail here, other configurations are possible, for example where the upper and lower riser parts 1, 2 are in fact separate components attached around respective ends of upper and low riser parts, or are configured as strips or panels attached to the surfaces of upper and lower riser parts.

In the illustrated example, the weak link is provided by a simple shear pin 3 coupled between the upper and lower riser parts. Although only a single shear pin is illustrated in the Figures, a plurality of such pins or any other weak link mechanism may be provided. When the tensile force on the riser exceeds some pre-defined threshold, the weak link will release. The actual threshold can be adjusted by using, for example, shear pins with different default thresholds. The damping mechanism will be active after the weak link fails.

After failure or release of the weak link, the damping mechanism will allow an upward travel of the upper riser part 2 relative to the lower riser part 1 if an upwards force on the upper riser part 2 overcomes a threshold force. The threshold force is less than the force required to release a weak link device. The threshold force is a force sufficient to overcome the resistance generated by the damping mechanism formed by features 4, 5 and 6. The mechanism consists of an inner diameter restriction 4 of part 1. An annular sleeve or block 5 is provided between riser parts 1 and 2. The sleeve 5 has an outer diameter larger than the restriction 4. The sleeve 5 surrounds part 2, forming a fluid seal in the annular space between parts 1 and 2.

A shoulder 6 is formed around an outer surface of the upper riser part 2 to support the sleeve 5. The sleeve 5 initially rests on the shoulder 6 and is restricted from upwards motion by the inner diameter restriction 4 formed in the lower riser part 1. In the event that the weak link 3 fails, the upper riser part 2 will be able to stroke upwards relative to the lower riser part 1, provided that a sufficiently large tensile force continues to be applied. The sleeve 5 is forced upwards by the shoulder 6, deforming the lower riser part 1 as it travels, i.e. the diameter of the lower riser part 1 is enlarged.

Figure 2:
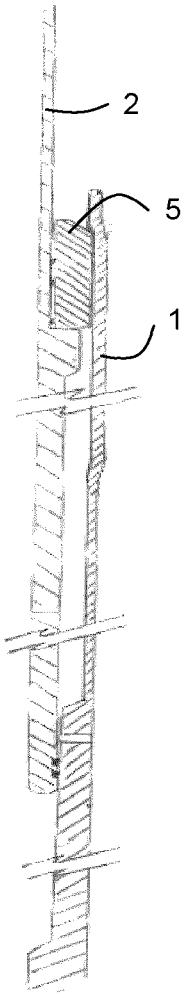
FIG. 2 shows a vertical cross section through a right hand side of a riser weak link section in a second, activated configuration following heave up.

FIG. 2 illustrates the riser configuration following failure of the weak link 3 and upward travel of the upper riser part 2. Deformation of the lower riser part 1 is a plastic deformation of the material and the deformation is permanent. The lower riser part 1 is preferably formed of a ductile material such as a relatively soft metal or metal alloy. Upper riser part 2 and sleeve 5 have a surface hardness which is higher than that of lower riser part 1 in order to avoid fretting problems. A larger strength of upper riser part 2 or sleeve 5 may be obtained by using a larger thickness when compared to lower riser part 1. The energy required to deform the lower riser part 1 damps the recoil of the upper riser part 2. The recoil can be controlled by appropriately selecting the length of the deformable region, as well as the shape of the deformable part. Complete separation of the upper and lower riser parts may or may not occur, depending upon the extent of movement of the riser and the desirability of separation.

Figure 3:
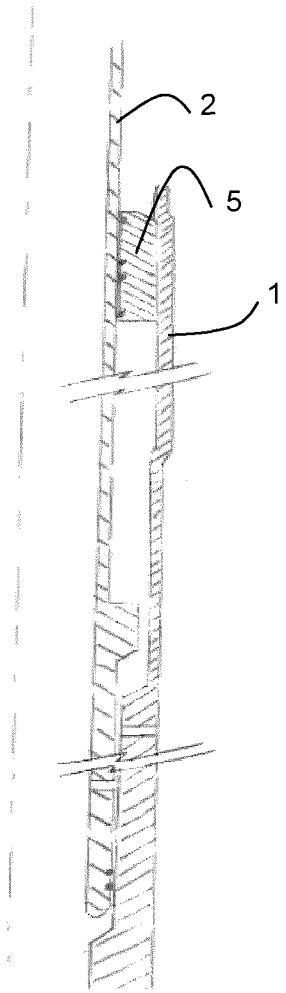
FIG. 3 shows a vertical cross section through a right hand side of a riser weak link section in a second, activated configuration following heave down.

The deformation process is such that, should the separating force between the riser parts 1 and 2 for some reason diminish or reverse direction before separation of the riser parts, the sleeve 5 will likely remain in its uppermost position with respect to the lower riser part 1, whilst the upper riser part 2 stroke downwards into the lower riser part 1. FIG. 3 illustrates this situation. The sleeve 5 continues to seal the annulus between the upper and lower riser parts, preventing leakage. If the tensile force returns of course, some further deformation may be achieved before separation of the riser parts occurs.

It will be appreciated that, following fracturing of the shear pin or weak link 3, relative rotation of the upper and lower riser parts may be permitted. This is advantageous as it can help to reduce torque forces in the riser.

Rotation due to a bending moment in the upper riser part will be accommodated by the radial clearance between lower riser part 1 and upper riser part 2. During stroking item 5 will in this situation progress slightly more at one side allowing upper riser to present an angle to the centre line of the lower riser.

The thickness of the lower riser part 1 above the restriction 4 can be varied axially, such that the force required to deform the restriction varies accordingly. Increasing or decreasing the thickness (i.e. radially inward extent) of the restriction will increase or decrease the force required to deform the restriction. This allows further control of the rate of separation of the upper and lower riser parts.

Embodiments that do not require a sleeve separate from the upper and lower riser part can be contemplated. For example, the shoulder 6 formed on the upper riser part 2 could have an outer diameter sufficiently large to contact and deform the lower riser part 1. The orientation of the riser parts may also be reversed, whereby the damping components provided on the lower riser part are instead provided on the upper riser part and vice versa.

Figure 4:
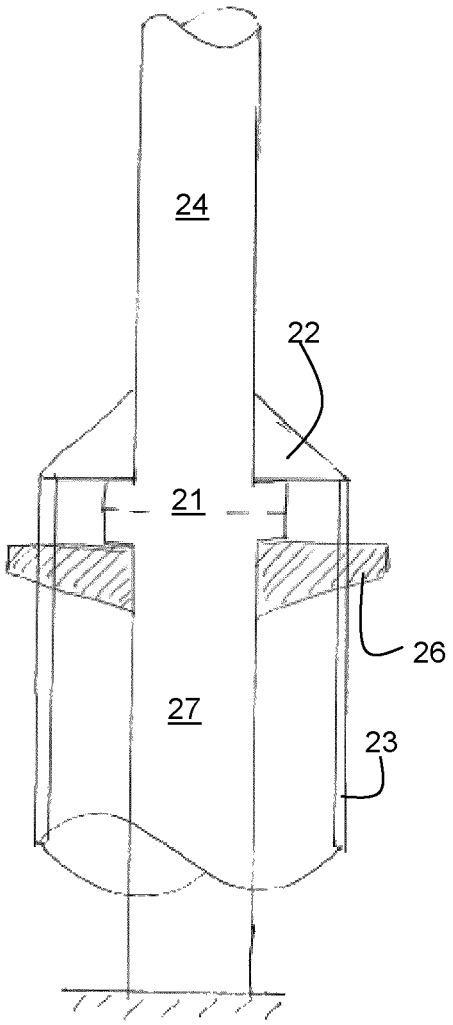
FIG. 4 shows a partial vertical cross section through a riser weak link section incorporating an alternative recoil damping mechanism.
Figure 5:
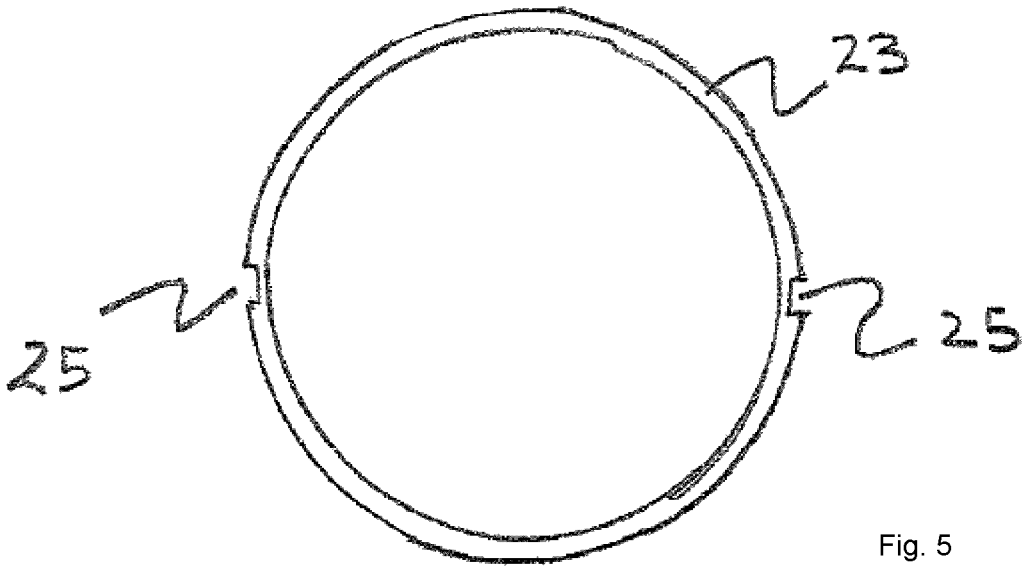
FIG. 5 shows a horizontal cross section through a shear pipe or plate.

An alternative mechanism for damping of riser recoil is illustrated in FIG. 4. The device is arranged around the riser, close to a weak link 21 formed within a collar 22. The collar 22 provides structural support for a shear pipe 23 and fixedly connects the shear pipe 23 to an upper riser section 24. The shear pipe 23 is made of a metal with highly plastic characteristics, such as aluminium. The shear pipe may have a pair or several pairs of diametrically opposed and axially extending weakened zones 25 as illustrated in FIG. 5 (a transverse cross section through the shear pipe. The lower side of the collar 22 supports a pair of shear knives 26 fixedly connected to a lower riser part 27.

Figure 6:
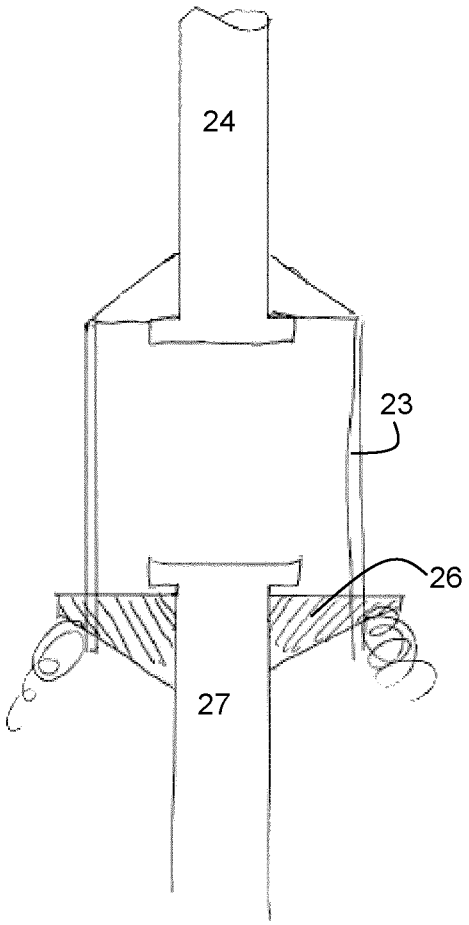
FIG. 6 shows a vertical cross section through a damping device.

Following failure or release of the weak link 21, the upper riser 24 will, without the presence of a damping mechanism, move upwards abruptly. However, with the damping mechanism in place, this upward movement will be slowed down by the force needed for the shear knives 26 to shear through the (weakened zones 25 of) metal of the shear pipe 23. The shear force required will depend on the thicknesses of the weakened zones 25 and the properties of the shear knives. Further control can be achieved by varying the number of shear knives and the axial length of the weakened zones 25/shear pipe 23, and by adjusting the properties of the pipe and knife materials. FIG. 6 shows the upper and lower riser parts still being connected following the relaxing of the tensile force on the riser, but in most cases complete separation may occur. By varying the thickness of the shear pipe axially an increasing or decreasing net force is needed to maintain the shearing action, further allowing control of the damping force.

Rotation between the two risers will be accommodated by one knife sharing further than the other allowing the two risers to have an angle between their respective center lines.

In the first embodiment disclosed above, the ductile material of part 1 is plastically deformed and the deformation is irreversible, but the ductile material does not fracture under the applied stress. In the second embodiment the ductile material is deformed to the point of fracture under the stress applied by the knives.

According to this further embodiment (FIG. 4), no seal is provided between the upper and lower riser parts after shearing, because the cut-away recess forms an opening through which fluids can leak out. Seals may however be provided around the device.

As discussed, the shear pipe 23 may be cylindrical, being arranged co-axially about the riser. In an alternative design, the shear pipe may be replaced by flat plates, e.g. one plate per knife. The plates and knives are preferably arranged symmetrically around the riser, such that the damping device does not cause sideways movement of the riser.

The shear pipe mechanism may be used in combination with the device of FIGS. 1 to 3, and/or multiple shear pipes may be used on the same riser. The orientation of the shear pipe and shear knives on the upper and lower riser parts may be reversed.

By varying the thicknesses of the weakened zones 25 along their lengths, the force required to shear the shear pipe can be controlled, e.g. to present a gradually reducing or increasing shear force.

The knives and the shear pipe supports (e.g. collar 22) may be attached to the riser pipe such that they can rotate with respect to the riser pipe to avoid torque after weak link release.

An advantage of the embodiments described above is that there is no delay in damping the sudden motion of the upper riser part after failure or release of the weak link. The mechanisms can also help to maintain a connection between the upper and lower riser parts, provided that the upward movement of a ship or platform does not exceed the operational length of the damping mechanism. The amount of damping along the length of the mechanisms may be controlled by varying the thickness of the materials and choosing the stiffness of the material or properties of the material. The mechanisms are also relatively simple and cost-effective when compared with, for example, hydraulic damping means. As this is a safety function meant to operate in an accidental case, the simplicity will positively affect the reliability.

A further issue that might need to be considered when a weak link fails is that the riser may contain a substantial amount of gas under high pressure, such that, assuming complete separation of the upper and lower riser parts, the upper riser part will be driven upwards by the escaping gas, increasing the recoil force. The presence of gas and the possible release of a weak link mechanism are independent events and in order to have an optimum recoil system the estimation of the necessary damping force will be challenged by the presence of a gas jet force. To address this problem, a flow restrictor or valve may be introduced at the bottom of the upper riser part, with the valve being configured to close following breaking of the weak link thus eliminating or minimizing this challenge. This will leave the added jet force out of the equation when scaling a damping device.

Figure 7:
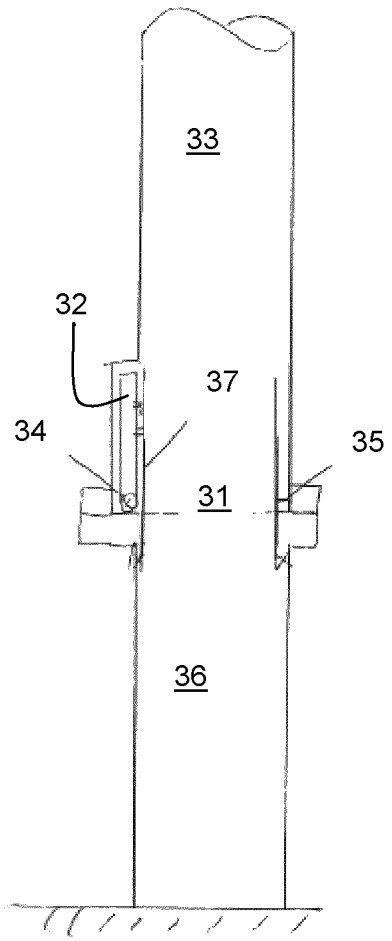
FIG. 7 shows a vertical cross section through a weak link device with a pressure end load suppression damping device.

FIG. 7 illustrates a riser comprising upper and lower riser parts on either side of a weak link 31, with a generally circular flapper valve 32 provided in the upper riser part 33, just above the weak link. A hinge 34 pivotally connects the flapper valve to the upper riser part. A flapper seat 35 extends around the inner circumference of the upper riser part, just above the weak link. A cylindrical flow tube 37 extends upwardly from the lower riser part to penetrate into the upper riser part and to hold the flapper valve 32 open in the normal operating configuration. If the weak link 31 fractures, the upper and lower riser parts will move apart and the flow tube 37 will be withdrawn from the upper riser part allowing the flapper flow tube to close against the flapper seat 35 as a result of the force exerted by the pressurised gas within the upper riser part. In addition to gravity acting on the flapper a spring may help the flapper to close.

Figure 8:
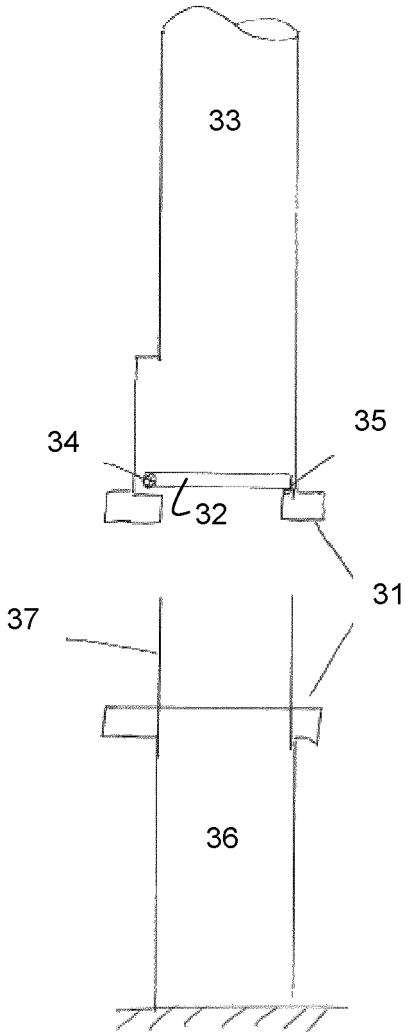
FIG. 8 shows a vertical cross section through a weak link device with a pressure end load suppression damping device engaged as a result of the weak link release.

In FIG. 8 the fractured weak link 31 is shown with the flapper valve 32 in its closed position. Closing of the flapper valve should be rapid, with the valve closing fully, immediately following fracture of the weak link. Although it is preferable to completely seal the lower end of the upper riser part with the flapper valve, this is not essential as a small leak will not yield an upward force of a significant magnitude.

The following alternatives may be considered:

The flapper valve may include a spring arrangement to help close the flapper.

The flapper assembly may be a separate unit that is connected between the weak link and the upper riser.

The flapper assembly may be an integral part of a weak link unit.

The flapper valve mechanism may be used as a standalone mechanism to reduce riser recoil, or it may be used in combination with one of the damping mechanisms described above with reference to FIGS. 1 to 6. In the latter case, the flapper valve may be configured to close either before or after complete separation of the upper and lower riser parts.

It will be appreciated by the person of skill in the art that various modifications may be made to the above described embodiments without departing from the scope of the present invention.

The invention claimed is:

1. An apparatus for use with a subsea well, comprising:

an upper riser part;

a lower riser part;

a weak link coupling the upper and lower riser parts together; and a mechanism coupled between the upper and lower riser parts for damping recoil of the upper riser part following a breaking of the weak link, damping resulting from a plastic deformation of a component or components of the mechanism occurring as the upper and lower riser parts separate, wherein said mechanism comprises a first part coupled to or integral with said lower riser part, and a second part coupled or integral with said upper riser part, the first and second parts cooperating to plastically deform any one of the first and second parts following the breaking of the weak link.

2. The apparatus according to claim 1, wherein said plastic deformation is a cutting through the second part by the first part.

3. The apparatus according to claim 2, wherein said first part comprises one or more shear knives and said second part comprises a shear plate or plates, and wherein said plastic deformation is achieved by the shear knife or knives cutting through the shear plate(s).

4. The apparatus according to claim 3, wherein said second part comprises a cylindrical shear plate arranged coaxially about one or both of the riser parts, and said shear knife or knives extend radially outward from the upper or lower riser part.

5. The apparatus according to claim 3, wherein the or each shear plate is formed with a weakened area or areas extending axially along the plate such that each weakened area is engaged, following a breaking of the weak link, by a shear knife.

6. The apparatus according to claim 5, wherein the or each weakened area has:

a constant radial thickness along its axial extent; or a varying radial thickness along its axial extent such that the damping force exerted by the mechanism is controlled as the upper and lower riser parts separate.

7. The apparatus according to claim 2, wherein said first and second parts comprise respective cylinders, telescopically engaged with one another.

8. The apparatus according to claim 7, further comprising a fluid tight seal formed between said first and second parts so as to contain fluid within the riser.

9. The apparatus according to claim 7, wherein one of the cylinders has formed thereon a restriction that is engaged by the other of the cylinders, or by a component supported by the other of the cylinders, during riser recoil to cause said plastic deformation.

10. The apparatus according to claim 9, wherein said component is an annular sleeve supported on a shoulder formed in the supporting cylinder.

11. The apparatus according to claim 1, wherein said plastic deformation is a bending in or of said second part by said first part.

* * * * *